US006470774B2

(12) United States Patent
Chang

(10) Patent No.: US 6,470,774 B2
(45) Date of Patent: Oct. 29, 2002

(54) STRUCTURE PLIERS FOR INNER AND OUTER DIAMETER C-SHAPED SNAP

(76) Inventor: Hsueh Chin Chang, P.O. Box 63-150, Taichung City (406) (TW)

( * ) Notice: Subject to any disclaimer, the term of this patent is extended or adjusted under 35 U.S.C. 154(b) by 9 days.

(21) Appl. No.: 09/961,744

(22) Filed: Sep. 22, 2001

(65) Prior Publication Data

US 2002/0053262 A1 May 9, 2002

(51) Int. Cl.[7] ..... B25B 7/12

(52) U.S. Cl. ..... 81/302; 29/229

(58) Field of Search ..... 81/302, 486, 416, 81/421, 422, 424, 427, 341, 342; 29/229

(56) References Cited

U.S. PATENT DOCUMENTS

| | | | | | |
|---|---|---|---|---|---|
| 3,662,449 | A | * | 5/1972 | Hashimoto | 29/229 |
| 4,476,750 | A | * | 10/1984 | Murphy | 81/300 |
| 4,790,056 | A | * | 12/1988 | Anderson | 29/229 |
| 5,327,802 | A | * | 7/1994 | Yu | 81/312 |
| 5,483,732 | A | * | 1/1996 | Wang | 29/229 |
| 5,515,587 | A | * | 5/1996 | Pool | 29/229 |
| 5,826,467 | A | * | 10/1998 | Huang | 81/302 |

* cited by examiner

*Primary Examiner*—Joseph J. Hail, III
*Assistant Examiner*—David B. Thomas

(57) ABSTRACT

An improved structure pliers for inner and outer diameter C-shaped snap rings comprised of a two-part symmetrically paired left and right-handled pliers body that is situated together at a predetermined point between its two inner sides and, furthermore, in an upper and lower overlaid and pivotably linked assembly positioning; two implement ends capable of being articulated apart and together by pivoting at the front portion and two hand grips for manual operation disposed at the rear portion; and an elastic component mounted between the two hand grips near their pivotable linkage area to provide a rebound force when the two hand grips are pivoted by squeezing. The two implement ends have a first mounting hole and a second mounting hole respectively formed in them and the two hand grips have a third mounting hole and a fourth mounting hole respectively formed in them near their pivotable linkage area. The two-part pliers body has a jaw at each of its two upper and lower two sides that are overlaid and in a pivotably linked assembly positioning and, furthermore, which respectively share the same pivotal axis. The two jaws have a through-hole disposed that corresponds to the site of the first mounting hole and second mounting hole, respectively, and attached to its front end are tip members capable of being turned up and down for angular adjustment to facilitate C-type snap ring distension or constriction. Positioned at each of the upper and lower two sides of the two jaws in a movable arrangement and, furthermore, respectively along the same axis is a direction control component. Each direction control component has projecting from it a long post and a short post that are respectively inserted into the mounting holes, enabling the tip members at the two sides of the jaws to either distend or constrict in operation and thereby provide inner and outer diameter C-shaped snap ring installation and removal in various spatial operating environments.

3 Claims, 7 Drawing Sheets

STRUCTURE PLIERS FOR INNER AND OUTER DIAMETER C-SHAPED SNAP

BACKGROUND OF THE INVENTION

1) Field of the Invention

The invention herein relates to a type of specialized hand tool, specifically an improved structure pliers for inner and outer diameter C-shaped snap rings.

2) Description of the Prior Art

There are generally two types of conventional snap ring pliers structures in common usage at present: the fixed type and the reversible type; as indicated in FIG. 1, the reversible type is typically comprised of a pliers body 1 that provides for manual handling and the application of a squeezing force; the said pliers body 1 consists of two handles 2 conjoined to form a fulcrum and, furthermore, movably coupled such that the front end is articulated apart in the opposite direction; a pin 4 projects from the left and right front ends of the handles 2; the said two pins 4 are conjoined to a pair of jaws 5 and a pivot shaft is installed between the said pair of jaws 5 such that when the pins 4 at one end of the handles 2 are evenly positioned, the other end is in a open state and, furthermore, the said pair of jaws 5 has four holes 6 along the front and rear that provide for user selection of handle 2 pin 4 conjoinment mode such that during usage the front and rear end of the pair of jaws 5 can be alternately conjoined to the handles , enabling the handles 2 to distend or constrict at the curved front end or the two holes 6 at the curved end can be conjoined onto the handle 2 pin 4 such that the application of force to the handles 2 is against the other level front end of the pair of jaws 5, allowing the pair of jaws 5 to constrict when the handles 2 are squeezed and thereby change the direction of articulation for the installation and removal of conventional inner and outer diameter C-shaped snap rings; however, with this type of structure, due to the limited assembled spacing of mechanical components, accessing the two holes of the C-shaped snap ring at a level angle is often not possible and a pair of jaws 5 of another size and angle specification must be purchased to thereby comply with the various angular arrangements of different C-shaped snap rings and, furthermore, the frequent and repeated changing of the said pair of jaws 5 during utilization is quite inconvenient and the acquisition of so many different sized pairs of jaws 5 is not economical.

Referring to FIG. 2, the fixed type C-shaped snap ring pliers consists of two handles 8 crisscrossed to form a pliers body and overlaid jaws 9 capable of opening and closing on the handles 8; locating pins 10 nested in upper slots 11 are utilized at the front end of the handles 8 and the locating pins 10 are capable of moving through the curved course of the slots 11 such that when force is applied squeeze the handles 8, the two pincer elements 12 of the jaws 9 are articulated into an opened state and when the two pincer elements 12 and the handles 9 are thus articulated, the locating pins 10 are situated in the lower slots 13 of the jaws 9; as the said locating pins 10 are moving in a curved path through the upper slots 11 when an applied force 8 is causing the closure of the handles 8, the downward curved direction of the two pincer elements 12 of the jaws 9 are such that the locating pins 10 in the upper slots 11 angle into the lower slot 6 easily during C-shaped snap ring engagement and the two pincer elements 12 are immediately brought into closure; operationally, frequent slippage and control difficulty are problematic and, furthermore, mechanical component layout often does not allow the level entry of the jaws 9 in a straight line into the C-shaped snap rings; as a result, a new pair of pliers having different specifications must be purchased, which is a shortcoming similar to that of the said reversible type pliers in that this structure is also uneconomical.

In view of the said shortcomings, the inventor of the invention herein conducted extensive research and improvement based on many years of experience with the related products which culminated in providing solutions for the said shortcomings.

SUMMARY OF THE INVENTION

The primary objective of the invention herein is to provide an improved structure pliers for inner and outer diameter C-shaped snap rings capable of efficient inner and outer diameter C-shaped snap ring installation and removal applications in various spatial and angular operating environments.

Therefore, improved structure pliers for inner and outer diameter C-shaped snap rings of the invention herein is comprised of a two-part symmetrically paired left and right-handled pliers body that is situated together at a predetermined point between its two inner sides and, furthermore, in an upper and lower overlaid and pivotably linked assembly positioning; two implement ends capable of being articulated apart and together by pivoting at the front portion and two hand grips for manual operation disposed at the rear portion; and an elastic component mounted between the two hand grips near their pivotable linkage area to provide a rebound force when the two hand grips are pivoted by squeezing, the innovative features of which include:

The said two implement ends have a first mounting hole and a second mounting hole respectively formed in them; the said two hand grips have a third mounting hole and a fourth mounting hole respectively formed in them near their pivotable linkage area; each said mounting hole is circumferentially situated an equal radius in length way from the center point of the said overlaid and pivotably linked assembly positioning; the said two-part pliers body has a jaw at each of its two upper and lower two sides that are overlaid and in a pivotably linked assembly positioning and, furthermore, which respectively share the same pivotal axis; the said two jaws have a through-hole disposed that corresponds to the site of the said first mounting hole and second mounting hole, respectively, and attached to its front end are tip members capable of being turned up and down for angular adjustment to facilitate C-type snap ring distension or constriction; positioned at each of the upper and lower two sides of the said two jaws in a movable arrangement and, furthermore, respectively along the same axis is a direction control component; each said direction control component has perpendicularly disposed at their two lengthwise ends a long post and a short post that are situated relative to the said first mounting hole and third mounting hole as well as the said second mounting hole and fourth mounting hole, respectively; as such, the said long posts can be optionally inserted beyond the said jaw through-holes and coupled into the said first mounting hole (or the said second mounting hole) or the short posts can be optionally inserted into the said jaw through-holes such that the long posts are coupled into the said third mounting hole (or the said fourth mounting hole), thereby enabling the tip members at the two sides of the said jaws to either distend or constrict at various operating angles.

To enable the examination committee to further understand the objectives, innovative features, and functions of the invention herein, the brief description of the drawings below are followed by the detailed description of the most preferred embodiment.

DETAILED DESCRIPTION OF THE INVENTION

Figure 1:
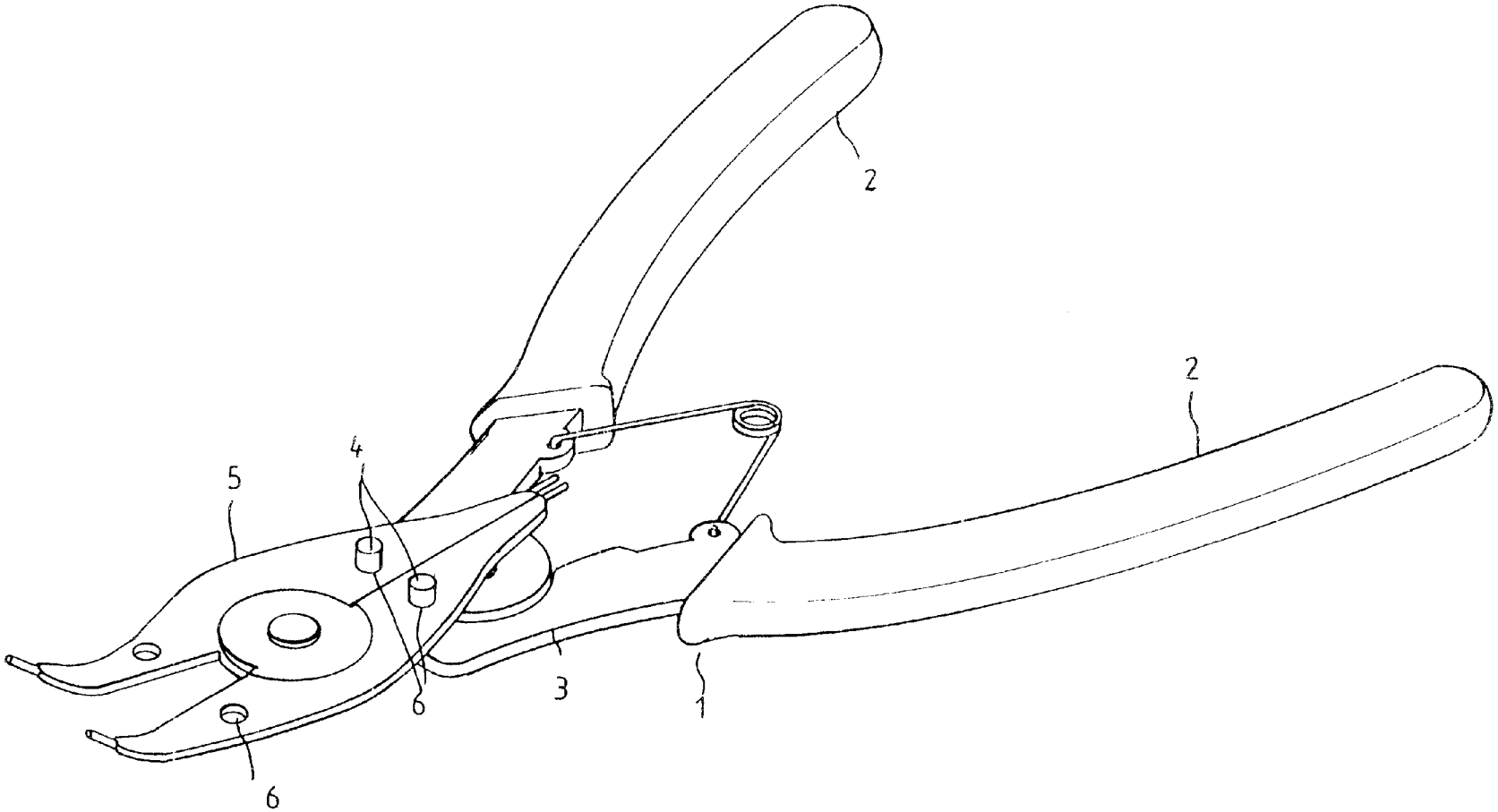
FIG. 1 is an isometric drawing of a conventional reversible snap ring pliers.
Figure 2:
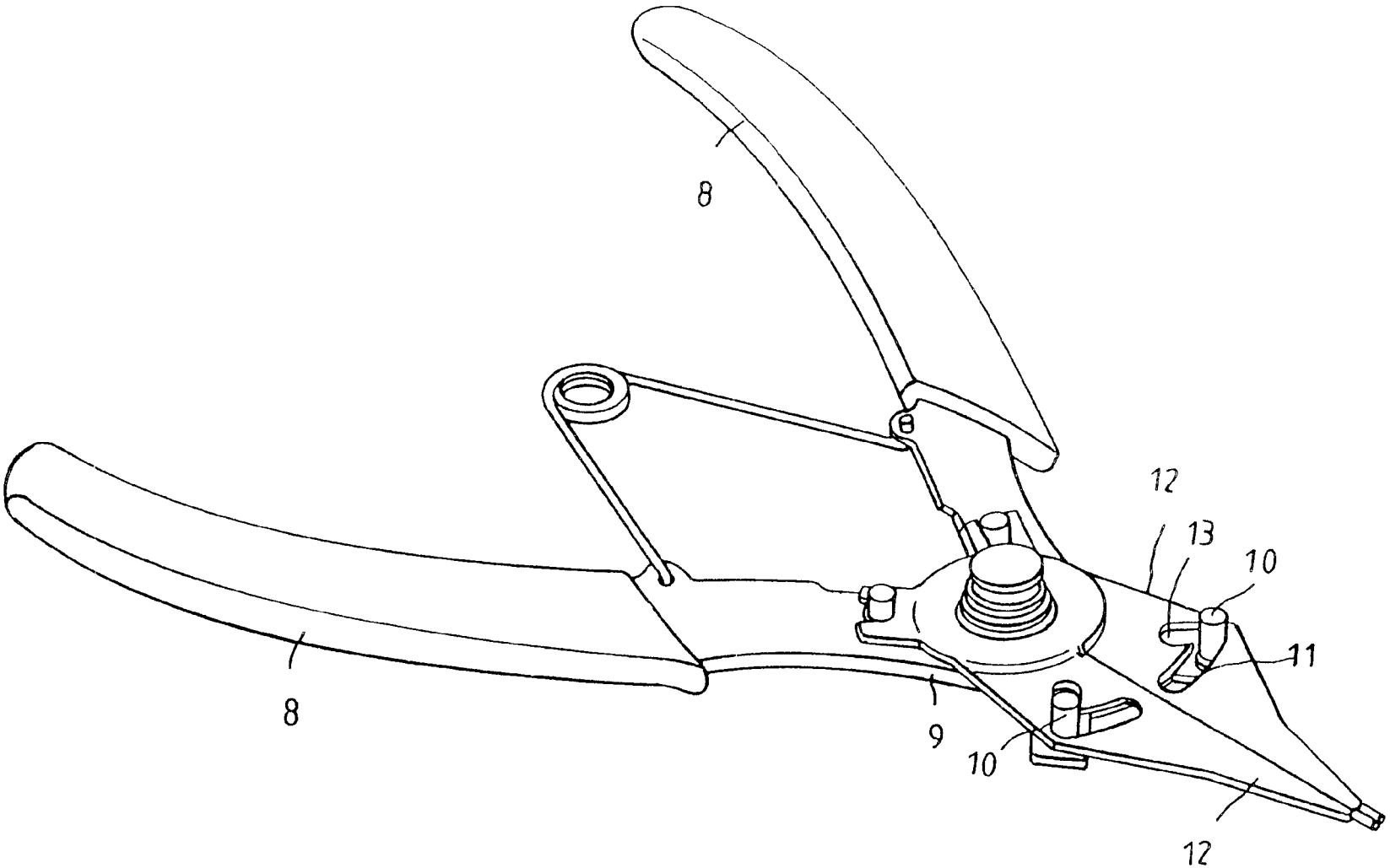
FIG. 2 is an isometric drawing of a conventional fixed snap ring pliers.
Figure 3:
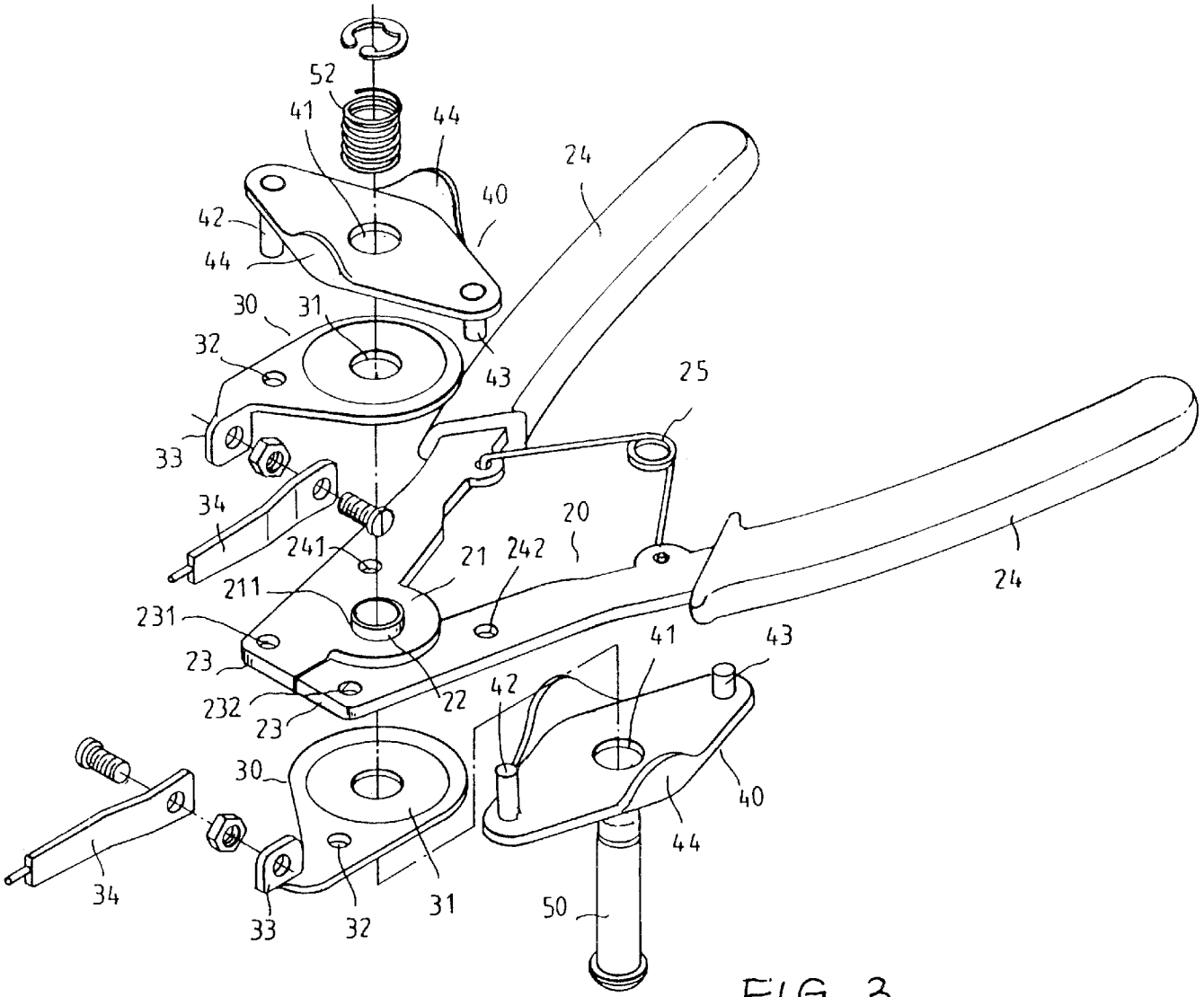
FIG. 3 is an exploded drawing of the most preferred embodiment of the invention herein.
Figure 4:
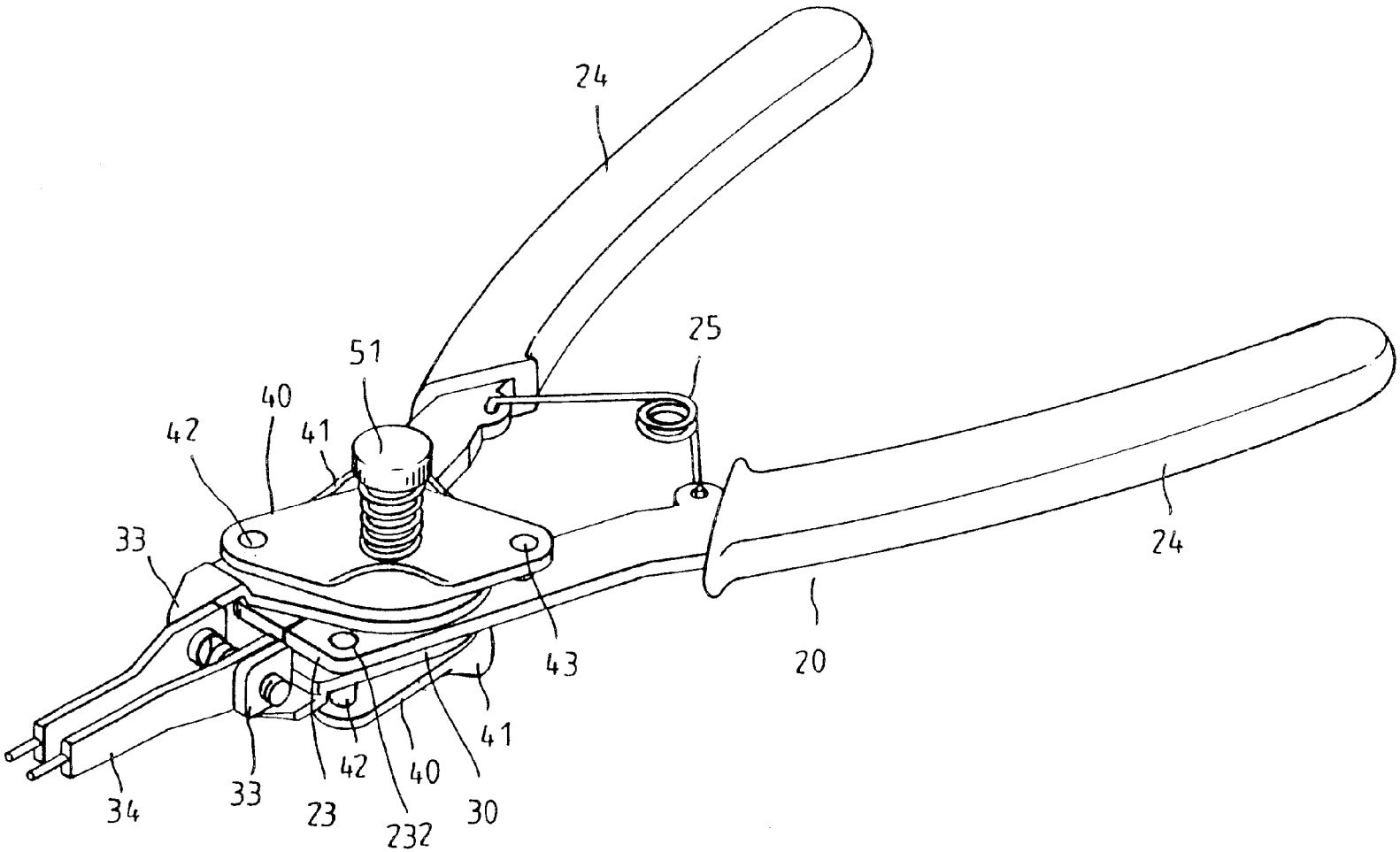
FIG. 4 is an isometric drawing of the most preferred embodiment of the invention herein.

Referring to FIG. 3 and FIG. 4, the improved structure pliers for inner and outer diameter C-shaped snap rings of the invention herein is comprised of a two-part plier body 20, two jaws 30, two direction control components 40, and a locating shaft 50, of which:

The said plier body 20 consists of a symmetric pair of left and a right curved handles with an inward facing fulcrum contour 21 projecting horizontally from each of its two sides, each said fulcrum contour 21 has a pivot hole 211 as well as upper and lower extending axially centered sleeves 22 that determine their overlaid and pivotably linked assembly positioning; two implement ends 23 capable of being articulated apart and together by pivoting are formed at the front portion of the assembly positioning and two hand grips 42 for manual operation are disposed at the rear portion of the assembly positioning; an elastic component 25 is mounted between the said two hand grips 24 near their pivotable linkage area to provide a rebound force when the two hand grips 24 are pivoted by squeezing; a first mounting hole 231 and a second mounting hole 232 are respectively formed in the said two implement ends 23; a third mounting hole 241 and a fourth mounting hole 242 are respectively formed in the said two hand grips 24 near their pivotable linkage area; the said mounting holes 231, 232, 241, and 242 are all circumferentially situated an equal radius in length way from the center point of the said overlaid and pivotably linked assembly positioning defined by the axially centered sleeves 22.

The said two jaws 30 are figured planar bodies having a round hole 31 in their centers that are situated at the end of the pivotable linkage positioning in alignment with the said axially centered sleeves 22, a through-hole 32 is disposed that corresponds to the site of the said first mounting hole 231 and second mounting hole 232, respectively, and a fastening tab 33 projects from the front ends; each said fastening tab 33 consists of a movably installed tip member 34 capable of being turned up and down for angular adjustment to facilitate C-type snap ring c distension or constriction.

The said direction control components 40 are oval planar bodies having a round hole 41 in their centers that are respectively positioned in a movable arrangement against the upper and lower sides of the round holes 31 of the said two jaws 30; perpendicularly disposed at each of their two lengthwise ends is a long post 42 and a short post 43, the positional separation of which corresponds to the distance between the said first mounting hole 231 and third mounting hole 241 as well as the distance between the said second mounting hole 232 and fourth mounting hole 242; the lengths of the said long posts 42 are sufficient to enable insertion beyond the said jaw 30 through-holes 32 and coupling into the said first mounting hole 231 or the second mounting hole 232 and, alternatively, when the direction control components 40 are rotated to the other side, coupling into the third mounting hole 241 and the fourth mounting hole 242 of the opposite hand grip 24; the lengths of the short posts 43 are only sufficient to enable insertion into the said jaw 30 through-holes 32 or maintain free clearance above the third mounting hole 241 and the fourth mounting hole 242 of the opposite hand grip 24 when the long posts 42 are coupled into the said first mounting hole 231 or the second mounting hole 232; to enable the easy rotational operation of the direction control components 40, a pinch section 44 extends upward from each of its opposing widthwise ends to facilitate more convenient finger manipulation.

The said locating shaft 50 is colinearly inserted into the said axially centered sleeves 22 and movably positions both direction control components 40 at the two sides of the said axially centered sleeves 22; a stop section 51 is disposed at its top end and an elastic component 52 is sleeved onto its lower extent, thereby providing for an axially oriented tensile force of pincer pressure when the said components are assembled.

The said assembly results in the improved structure pliers for inner and outer diameter C-shaped snap rings of the invention herein and, as indicated in FIG. 4, is capable of efficient inner and outer diameter C-shaped snap ring installation and removal applications in various spatial and angular operating environments.

Figure 5:
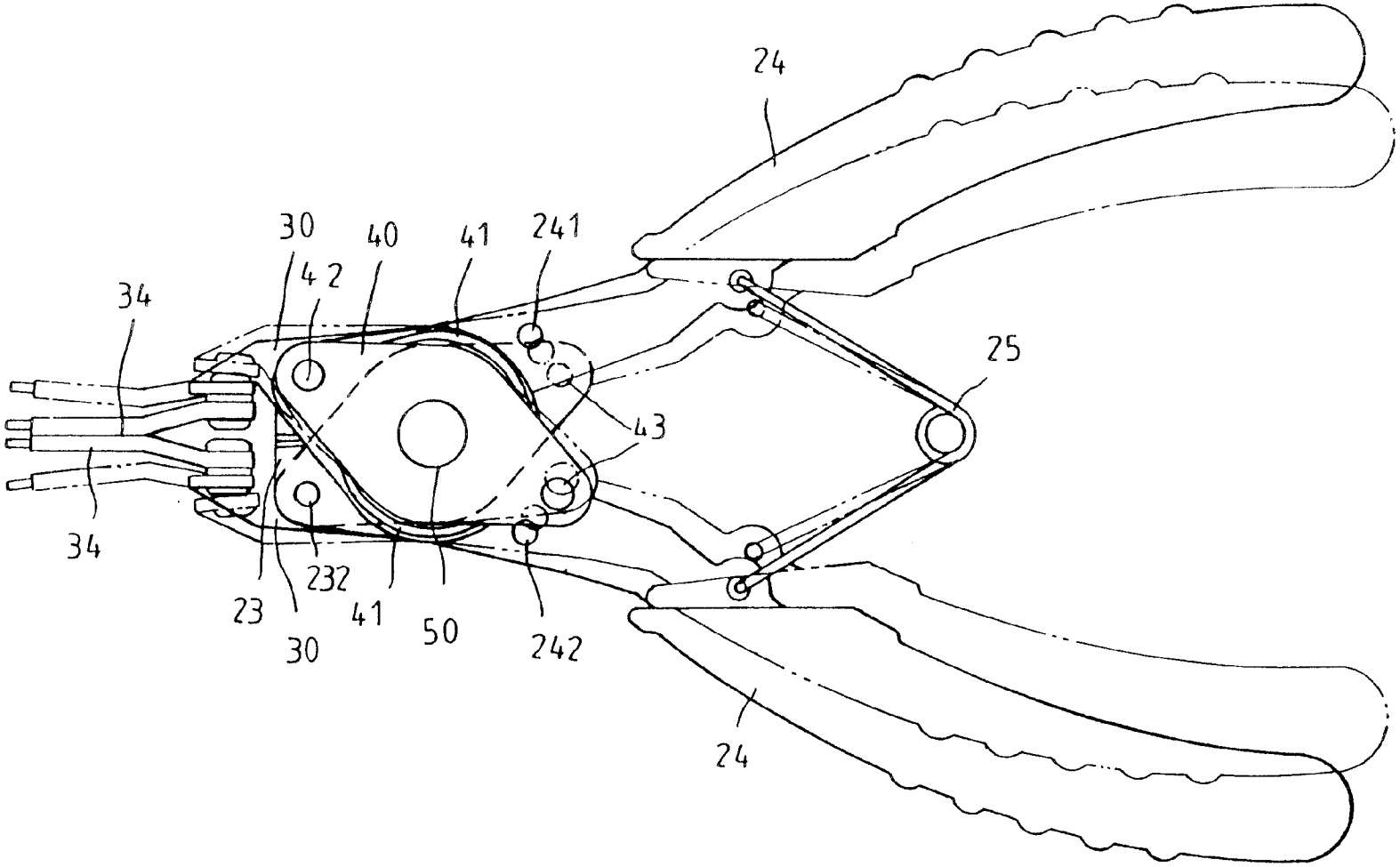
FIG. 5 is an isometric drawing of the invention herein that illustrates the distension of the jaws.

When the user wants to utilize the two tip members 34 for distension, as indicated in FIG. 5, pressure is first applied or released in an axial orientation to achieve pivoting around the said locating shaft 50, while the direction control components 40 at the upper and lower two sides are manipulated to axially disengage them for rotation in the opposite direction such that the lengths of the said long posts 42 can be inserted beyond the said jaw 30 through-holes 32 and coupled into the said first mounting hole 231 and second mounting hole 232, respectively; at the same time, the lesser lengths of the said short posts 43 are only capable of maintaining free clearance above the third mounting hole 241 and the fourth mounting hole 242; as such, the said jaws 30 and the implement ends 23 are configured into a unified structural entity having a relationship of interconnected leverage such that when the two hand grips 24 are squeezed, the two implement ends 23 at their opposite extremities open outward, naturally causing the two tip members 34 fastened to the said implement ends 23 to simultaneously proceed outward to execute the distension operation.

Figure 6:
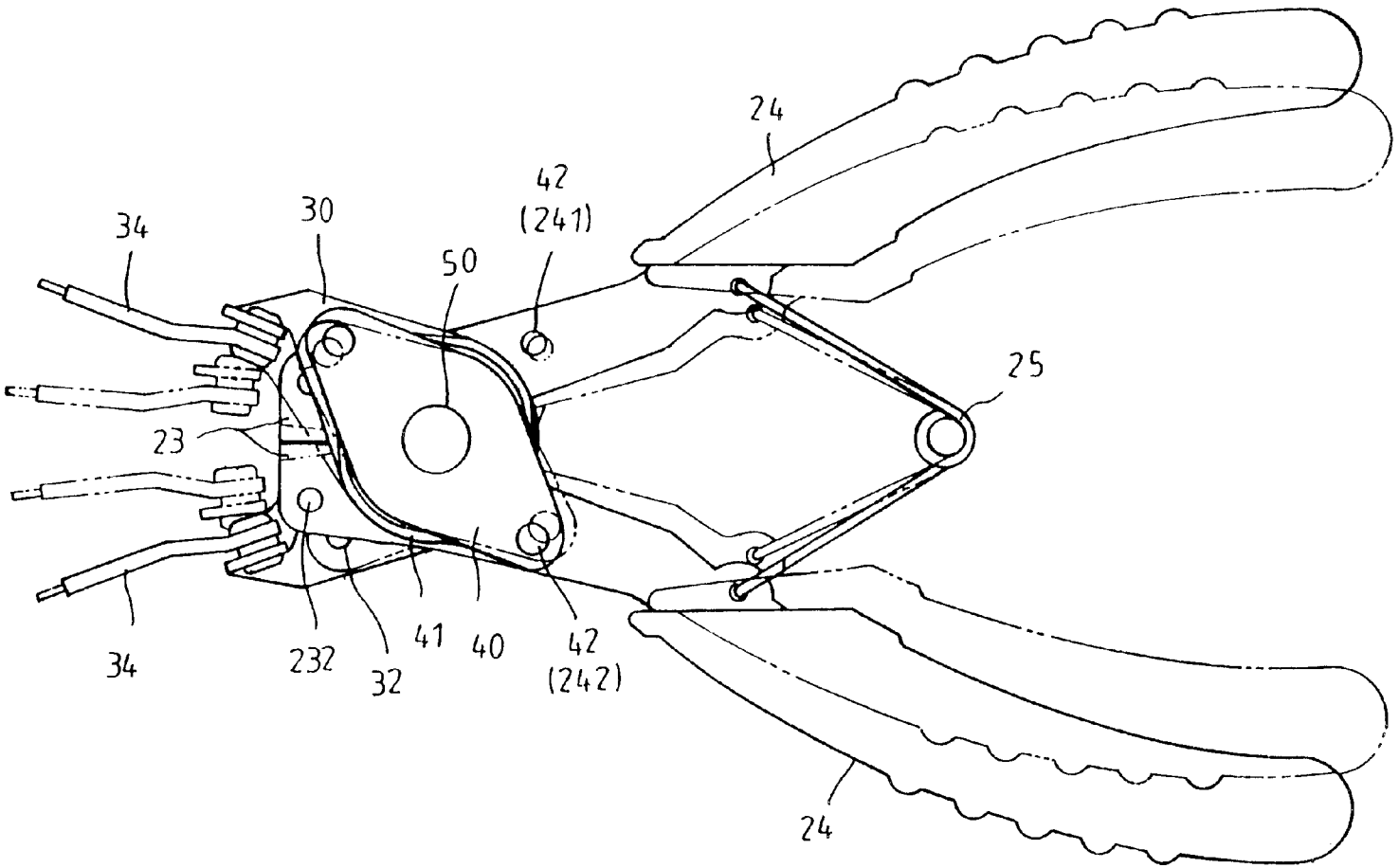
FIG. 6 is an isometric drawing of the invention herein that illustrates the constriction of the jaws.
Figure 9:
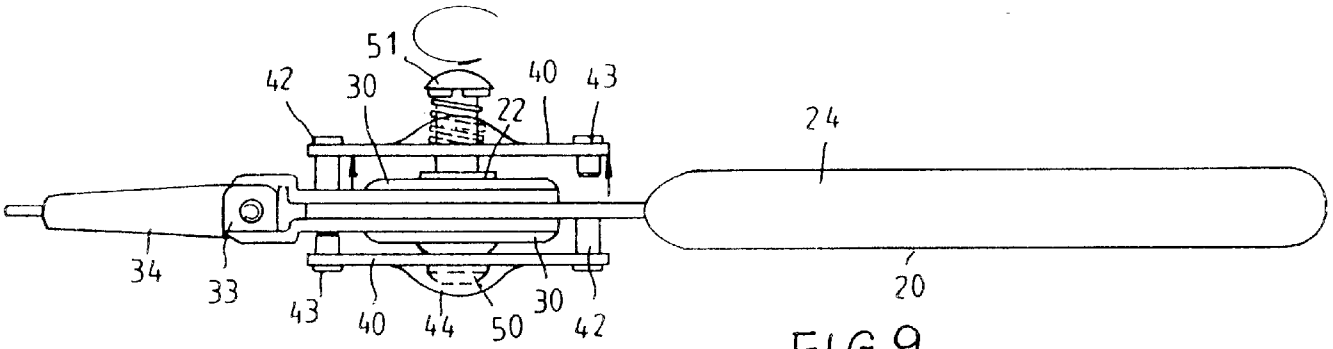
FIG. 9 is an orthographic drawing of the most preferred embodiment of the invention herein (2).
Figure 8:
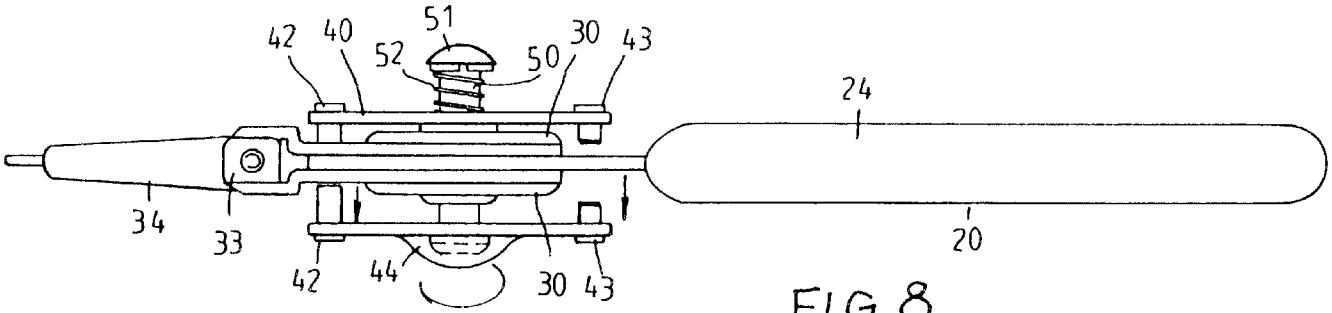
FIG. 8 is an orthographic drawing of the most preferred embodiment of the invention herein (1).
Figure 7:
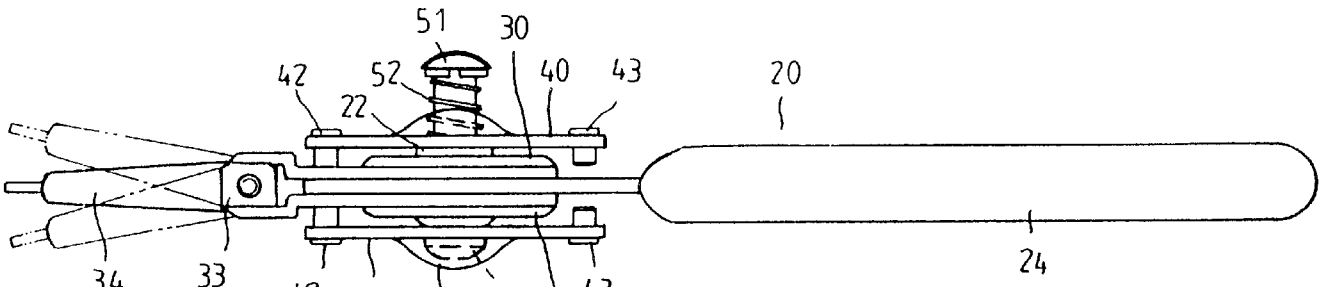
FIG. 7 is a partial cross-sectional drawing of the most preferred embodiment of the invention herein.

Conversely, when the user wants to utilize the two tip members 34 for constriction, as indicated in FIG. 6, pressure is first applied or released in an axial orientation to achieve pivoting around the said locating shaft 50, while the direction control components 40 at the upper and lower two sides are manipulated to axially disengage them for rotation in the opposite direction such that the lengths of the said long posts 42 can be withdrawn from the said jaw 30 through-holes 32 and shifted into the said third mounting hole 241 and the fourth mounting hole 242 in the said other hand grip 24, respectively; at the same time, the said short posts 43 originally in a state of maintained free clearance above the third mounting hole 241 and the fourth mounting hole 242 are turned around and inserted into the said jaw 30 through-holes 32; as such, the implement ends 23 are separated from the said jaws 30, the direction control components 40 and the implement ends 23 are conjoined, and the long posts 42 at the other end of the direction control, and the direction control components 40 are coupled into the third mounting hole 241 and the fourth mounting hole 242 of the hand grip 24 to configure them into a unified structural entity having a relationship of interconnected leverage such that when the two hand grips 24 are squeezed, the two implement ends 23 at their opposite extremities close, naturally causing the two tip members 34 fastened to the said jaws 30 proceed inward simultaneously to execute the constriction operation.

When the user faces a C-shaped snap ring operation involving limited space above and below or to the left or right, it is only necessary to effect an angular adjustment by turning the two tip members 34 of the said jaw 30 an appropriate number of degrees, which easily enables access for both inner and outer diameter snap ring installation or removal without requiring the replacement of parts or using another pair of pliers to complete the operation; therefore, since the invention herein is of an original structural arrangement capable of overcoming the problems of the prior art, the pliers of the present invention is certain to become of widespread worldwide demand due to its enhanced performance and utility.

What is claimed is:

1. An improved structure pliers for inner and outer diameter C-shaped snap rings comprised of a two-part symmetrically paired left and right-handled pliers body that is situated together at a predetermined point between its two inner sides and, furthermore, in an upper and lower overlaid and pivotably linked assembly positioning; two implement ends capable of being articulated apart and together by pivoting at the front portion and two hand grips for manual operation are disposed at the rear portion; and an elastic component mounted between the said two hand grips near their pivotable linkage area to provide a rebound force when the said two hand grips are pivoted by squeezing, the innovative features of which include:

the said two implement ends have a first mounting hole and a second mounting hole respectively formed in them; the said two hand grips have a third mounting hole and a fourth mounting hole respectively formed in them near their pivotable linkage area; each said mounting hole is circumferentially situated an equal radius in length way from the center point of the said overlaid and pivotably linked assembly positioning; the said two-part pliers body has a jaw at each of its two upper and lower two sides that are overlaid and in a pivotably linked assembly positioning and, furthermore, which respectively share the same pivotal axis; the said two jaws have a through-hole disposed that corresponds to the site of the said first mounting hole and the said second mounting hole, respectively, and attached to its front end are tip members capable of being turned up and down for angular adjustment to facilitate C-type snap ring distension or constriction; positioned at each of the upper and lower two sides of the said two jaws in a movable arrangement and, furthermore, respectively along the same axis is a direction control component; each said direction control component has perpendicularly disposed at their two lengthwise ends a long post and a short post that are situated relative to the said first mounting hole and the said third mounting hole as well as the said second mounting hole and the said fourth mounting hole, respectively; as such, the said long posts can be optionally inserted beyond the said jaw through-holes and coupled into the said first mounting hole (or the said second mounting hole) or the said short posts can be optionally inserted into the said jaw through-holes such that the said long posts are coupled into the said third mounting hole (or the said fourth mounting hole), enabling the said two implement ends at the two sides of the said jaws to either distend or constrict in operation and thereby provide inner and outer diameter C-shaped snap ring installation and removal in various spatial operating environments.

2. As mentioned in claim 1 of the improved structure pliers for inner and outer diameter C-shaped snap rings of the invention herein, the said pliers body consists of a symmetric pair of left and a right curved handles with an inward facing fulcrum contour projecting horizontally from each of its two sides, each said fulcrum contour has a pivot hole as well as upper and lower extending axially centered sleeves that determine their overlaid and pivotably linked assembly positioning; the said two jaws having a round hole in their centers that are situated at the end of the pivotable linkage positioning in alignment with the said axially centered sleeves; the said two direction control components each have a round hole in their centers and a locating shaft is colinearly inserted through both sides into the said axially centered sleeves; and, furthermore, movably disposed on the said locating shaft is the said elastic component that provides an axially oriented tensile force of pincer pressure.

3. As mentioned in claim 1 of the improved structure pliers for inner and outer diameter C-shaped snap rings of the invention herein, the said direction control components have a pinch section extending upward from each of its opposing width-wise ends to facilitate more convenient finger manipulation.

* * * * *